US008974188B2

(12) United States Patent
Hou

(10) Patent No.: US 8,974,188 B2
(45) Date of Patent: Mar. 10, 2015

(54) BLADE CLIP

(75) Inventor: Lin-Jun Hou, Carmel, IN (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 694 days.

(21) Appl. No.: 13/412,824

(22) Filed: Mar. 6, 2012

(65) Prior Publication Data

US 2013/0236317 A1 Sep. 12, 2013

(51) Int. Cl.
*F01D 5/32* (2006.01)
*F04D 29/34* (2006.01)

(52) U.S. Cl.
USPC ..... 416/220 R

(58) Field of Classification Search
CPC ..... F01D 5/32; F01D 5/326; F01D 5/323; F04D 29/322; F04D 29/323; F04D 29/325; F04D 29/329; F04D 29/34
USPC ..... 416/220 R, 221, 248; 29/889.2, 889.21
See application file for complete search history.

(56) References Cited

U.S. PATENT DOCUMENTS

| | | | | |
|---|---|---|---|---|
| 3,784,322 | A | 1/1974 | Erich et al. | |
| 4,451,203 | A | 5/1984 | Langley | |
| 4,848,959 | A | 7/1989 | Morrison | |
| 5,567,116 | A | 10/1996 | Bourcier | |
| 6,007,628 | A | 12/1999 | Ittleson et al. | |
| 6,302,651 | B1 | 10/2001 | Kildea et al. | |
| 7,415,763 | B2 * | 8/2008 | Miosga et al. | 29/889.21 |
| 8,113,784 | B2 * | 2/2012 | Gupta | 416/193 A |
| 2004/0062653 | A1 * | 4/2004 | Di Paola et al. | 416/221 |
| 2009/0053065 | A1 | 2/2009 | Oka | |
| 2009/0060746 | A1 | 3/2009 | Barr, Jr. et al. | |
| 2010/0239430 | A1 * | 9/2010 | Gupta | 416/97 R |
| 2011/0255982 | A1 | 10/2011 | Jan | |
| 2011/0280731 | A1 | 11/2011 | Xiao et al. | |
| 2011/0311358 | A1 | 12/2011 | Xiao et al. | |

OTHER PUBLICATIONS

Canadian Office Action from Canadian Application Serial No. 2,805,467, dated Feb. 18, 2014, 4 pages.

* cited by examiner

*Primary Examiner* — Edward Look
*Assistant Examiner* — Jesse Prager
(74) *Attorney, Agent, or Firm* — Kinney & Lange, P.A.

(57) ABSTRACT

A clip to connect a blade to a rotor disk, the blade with a root and a tip in a spanwise direction, and a leading edge and a trailing edge in a chordwise direction, the root with a bottom surface, includes a locking mechanism shaped to engage a complementary slot extending into the bottom surface of the blade root in the spanwise direction; a support connected to the locking mechanism extending the length of the bottom surface of the root in the chordwise direction; and first and second arms extending radially inward converging in an axial direction so that the arms are closer at their distal ends to engage the rotor disk.

20 Claims, 6 Drawing Sheets

BLADE CLIP

BACKGROUND

This invention relates generally to blades in a gas turbine engine, and specifically to clips to connect a blade root to a rotor disk.

A blade in a gas turbine engine has a root, which connects to the rotor disk, and a tip opposite the root. The thickness of the blade greatly changes over a short length at the root. The root enables the airfoil to withstand typical operational loads from rotation and bending and loads from foreign object strikes. The root typically slides into a slot in a rotor disk to hold the airfoil in place while the rotor disk is spinning.

SUMMARY

A clip to connect a blade to a rotor disk includes a locking mechanism shaped to engage a complementary slot extending into the bottom surface of the blade root in a spanwise direction; a support connected to the locking mechanism extending the length of the bottom surface of the root in the chordwise direction; and first and second arms extending radially inward converging in the axial direction so that the arms are closer at their distal ends to engage the rotor disk.

A method of locking a blade to a rotor disk with slots includes sliding a locking mechanism of a clip into a complementary slot extending from the bottom surface of blade root in the spanwise direction until a support of the clip sits directly below the bottom surface of the blade root; sliding the clip and blade root axially into a slot in the rotor disk; and bending a first arm on the clip radially inward to engage a concave surface on the rotor disk.

DETAILED DESCRIPTION

Figure 1A:
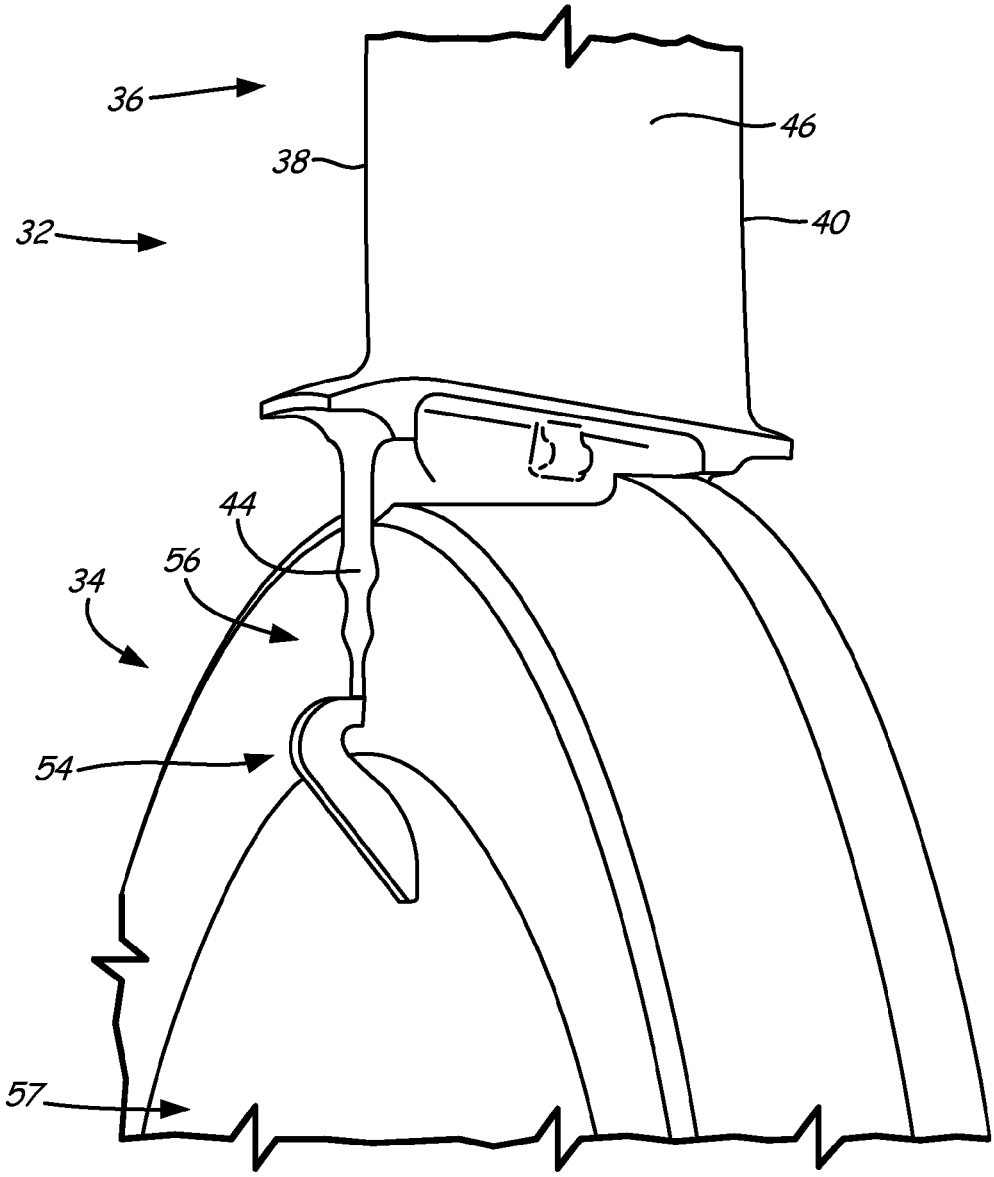
FIG. 1A shows a connection between a blade, a clip and a disk.
Figure 1B:
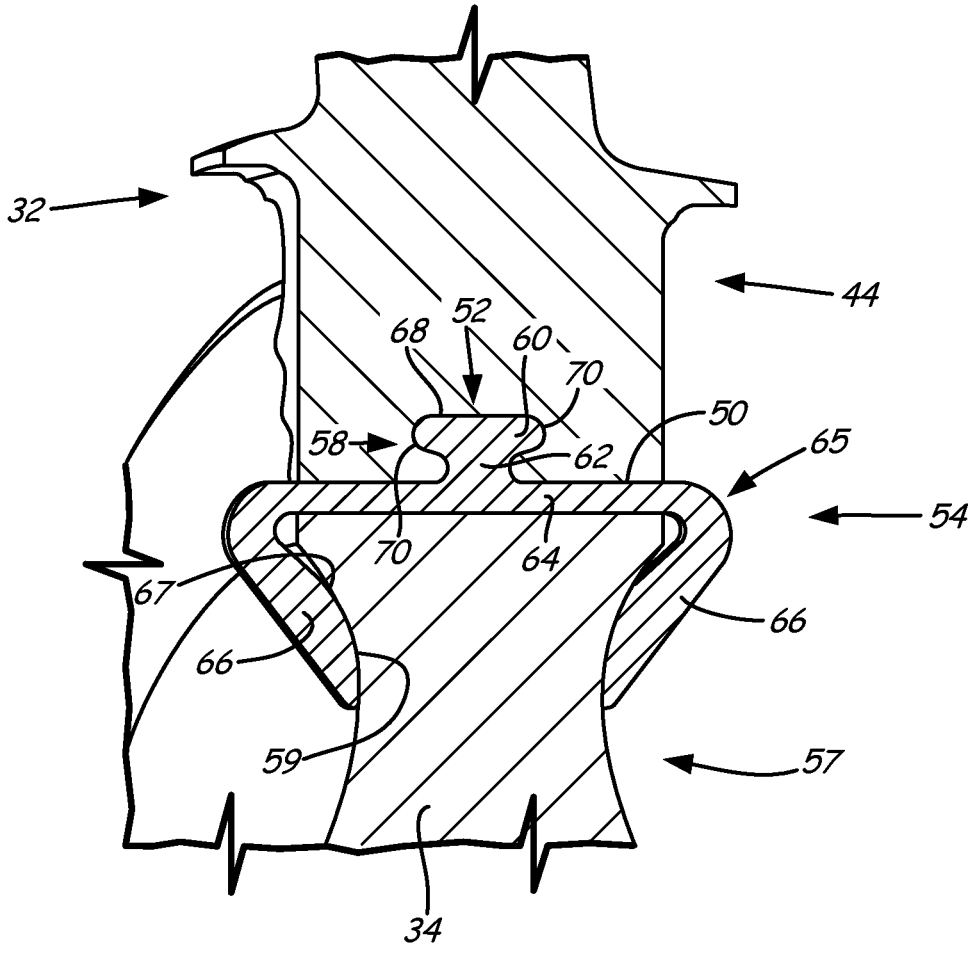
FIG. 1B shows a cross-sectional view of the connection between the blade, the clip and the disk of FIG. 1A.
Figure 1C:
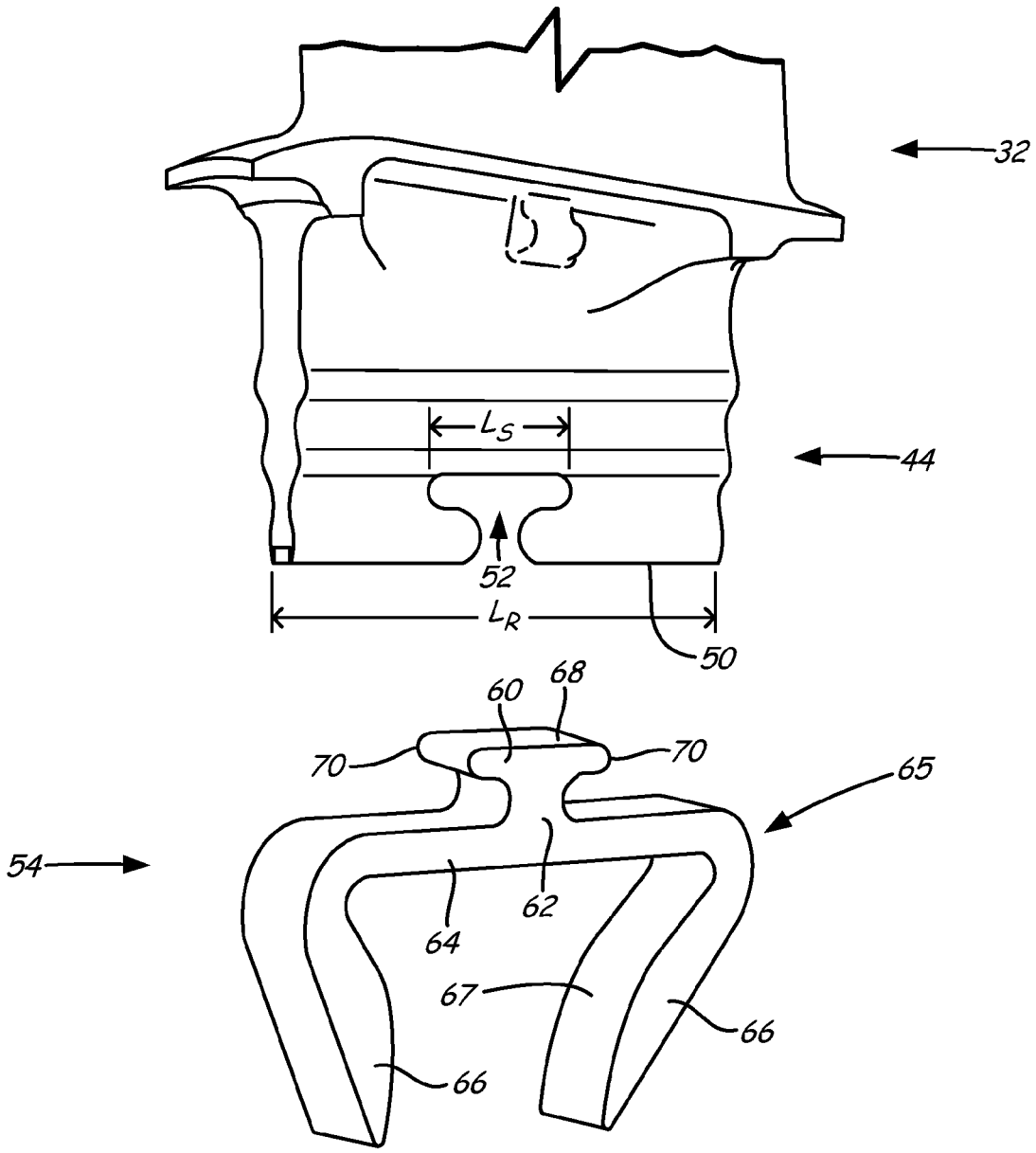
FIG. 1C shows an exploded perspective view of the clip and the blade of FIG. 1A.

FIG. 1A shows a connection between blade 32 and disk 34 in a gas turbine engine, FIG. 1B shows a cross-sectional view of the connection between blade 32 and disk 34, and FIG. 2C shows an exploded perspective view of clip 54 and blade 32. FIGS. 1A-1C include blade 32 with airfoil 36, leading edge 38 and trailing edge 40 in a chordwise direction, firtree root 44 opposite a tip (not shown) in a spanwise direction, pressure side 46 and suction side directly opposing pressure side 46 (not shown) and clip 54. Firtree root 44 includes bottom surface 50 and locking mechanism slot 52. Disc 34 includes firtree slots 56 and web 57 with concave surface 59. Firtree root 44 is inserted in slot 56 in disc 34. Clip 54 includes locking mechanism 58 with head 60 (with flat upper surface 68 and rounded sides 70) and neck 62, support 64, shoulders 65 and arms 66 with convex inner surface 67. Dimensions shown include length of root $L_R$ and length of slot $L_S$. While only blade 34 is illustrated, it is to be understood that in operation, a disk 34 would include a plurality of slots 56, and a blade that is substantially similar to blade 32 would be inserted into each slot 56 in disc 34, and a clip 54 would connect each blade 32 to disk 34.

Firtree root 44 of blade 32 and slot 56 in disc 34 are shaped so that root 44 slides into slot 56 (i.e., the shapes are complementary). Disc 34 spins, rotating blade 32. Root 44 retains blade 32, resisting the centrifugal load when disk 34 is spinning during engine operation.

Clip 54 engages root 44 through locking mechanism 58 and slot 52. In one embodiment, length of slot $L_S$ can be about ⅓ of the length of root $L_R$. Head 60 of locking mechanism is larger in the chordwise direction than neck 62 to secure clip 54 to root 44 and to give more contact area between clip 54 and root 44 for load transfer. In the embodiment shown, head 60 includes a flat upper surface 68 with rounded sides 70. Clip 54 engages rotor disk 34 through arms 66 bending radially inward toward each other so that convex inner surfaces 67 of arms 66 engage concave surface 59 of web 57 on forward and aft sides of disk 34. Support 64 of clip 54 supports bottom surface to distribute loads from root 44 to disk 34 and to keep blade 32 from shifting on disk 34. Clip 54 is generally one integral part and can be made of titanium (including alloys), aluminum (including alloys) or other materials depending on engine requirements.

Clip 54 with locking mechanism 58, support 64 arms 66 secures blade 32 to disk 34, helping to reduce stress on root 44 and prevent shifting on disk 34. Past systems either didn't include a clip when connecting blade to disk, or used a small clip with short radial arms and a small pin with radial sides. Clip 54 with locking mechanism 58 that includes head 60 which is larger than neck 62 and engages a slot extending into the bottom surface of root 44, provides a large interface contact area between clip 54 and blade 32 (upper surface 68 and sides 70), distributing loads through the thickness of root 44. By extending radially inwards to engage concave surface 67 on disk 34, arms 66 provide a secure connection between blade 32 and disk 34, connecting with a tight fit to disk 34 to transfer part of the centrifugal load to disk 34.

Figure 2A:
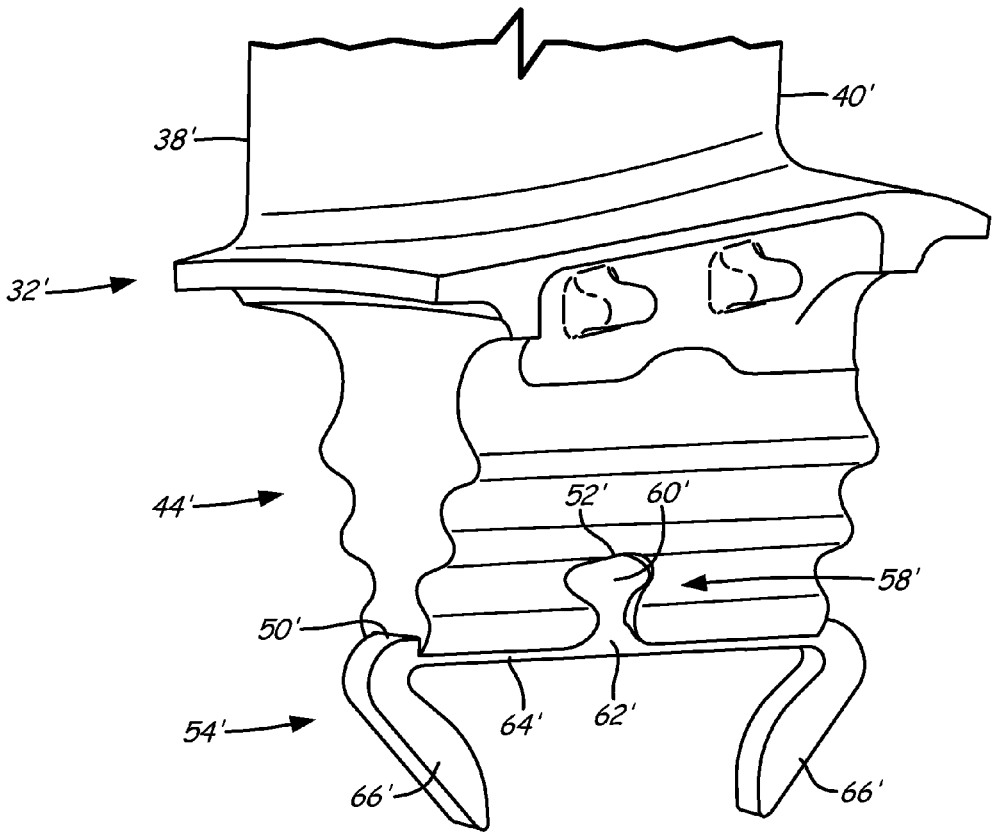
FIG. 2A shows a perspective view of a second embodiment of a clip with a root.
Figure 2B:
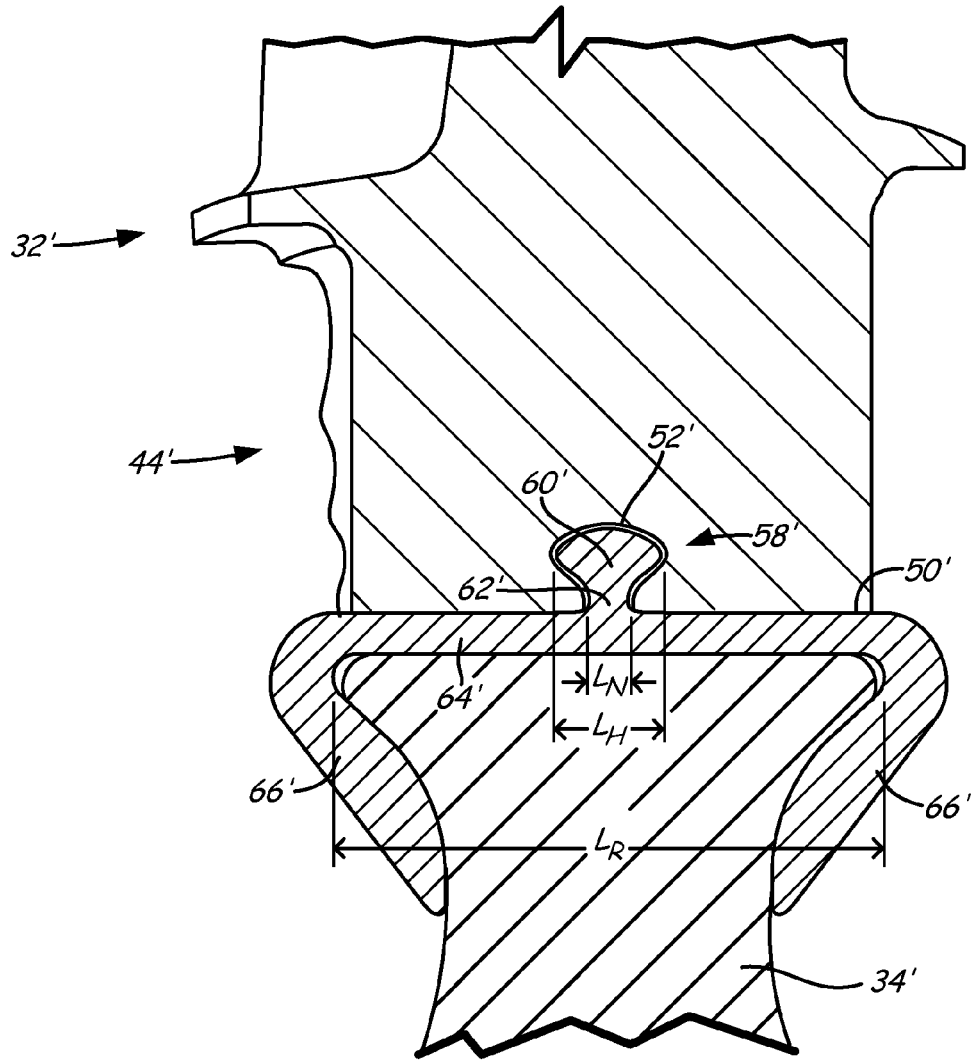
FIG. 2B shows a cross-sectional view of FIG. 2A.

FIG. 2A shows a perspective view of another embodiment of clip 54' with root 44', and FIG. 2B shows a cross-sectional view of FIG. 2A. FIGS. 2A-2B include blade 32' with leading edge 38', trailing edge 40', firtree root 44', and clip 54' with locking mechanism 58'. Locking mechanism 58' includes head 60' and neck 62', support 64' and arms 66'. Firtree root 44' includes bottom surface 50' and locking mechanism slot 52'. Dimensions shown include length of root $L_R$, length of head $L_H$ and length of neck $L_N$. In this embodiment, $L_H$ is about ⅕ of $L_R$, and $L_N$ is about ⅙ of $L_R$. Other embodiments can have different ratios.

In the embodiment shown in FIGS. 2A-2B, locking mechanism 58' has a bulbous shaped cross-section, with head 60' having a generally oval or round shape. Locking mechanism 58' provides a secure connection between clip 54' and root 44' and provides a substantial amount of mass in head 60 to shear some of the load transferring to disk 34', thereby minimizing stresses in root 44'. Support 64' and arms 66' are substantially the same as respective support arms 64, 66 shown in FIGS. 1A-1C.

Figure 3:
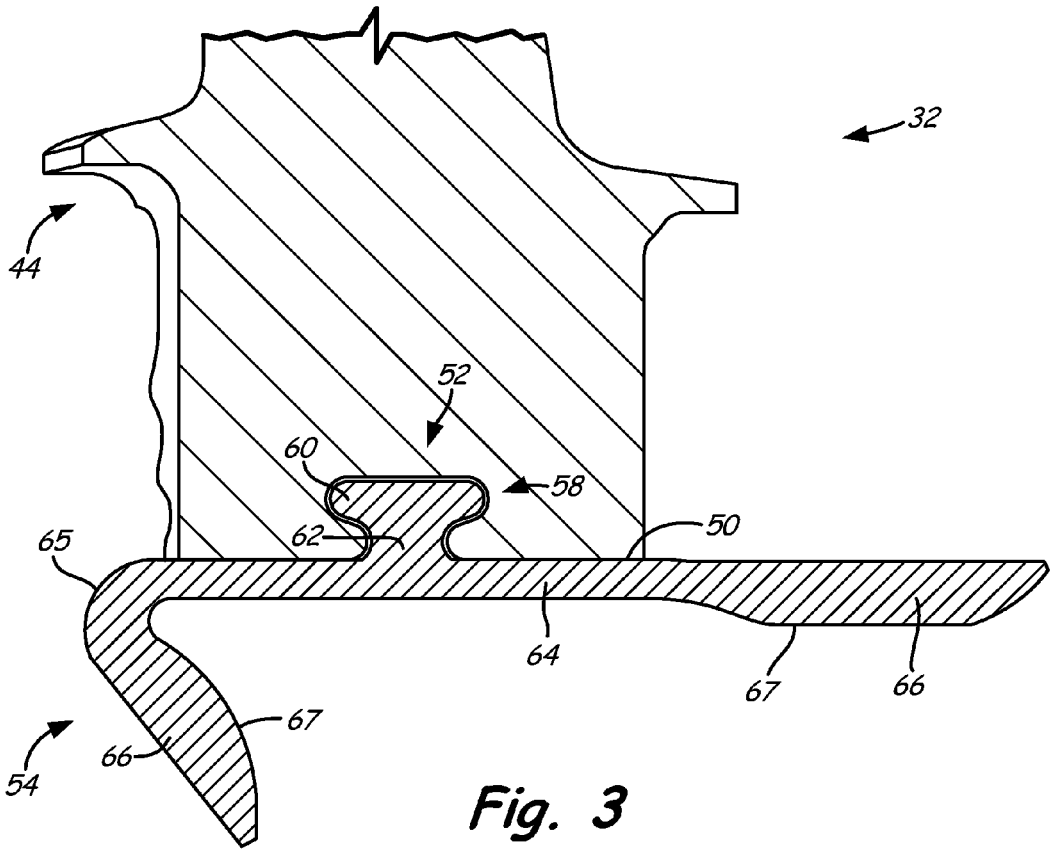
FIG. 3 shows a view of a clip connected to a root and with an arm axial for connecting to a disk.

FIG. 3 shows a cross-sectional view of clip 54 connected to root 44 and with an arm 66 axial for connecting blade 32 to a disk (not shown). Blade 32 includes firtree root 44 (with bottom surface 50 and locking mechanism slot 52) that is coupled to clip 54 (with locking mechanism 58 with head 60 and neck 62, support 64, shoulders 65 and arms 66 with convex inner surfaces 67). In this embodiment, one arm 66 is bent axially (i.e., towards the longitudinal axis of blade 32) for insertion of blade 32 into slot 56 (see FIG. 1A) of disk 34.

Blade 32 with clip 54 slides axially into slot 56 (FIG. 1A) in disk 34. Arm 66 can then be bent around disk 34 when connecting blade 32 to disk 34 (FIG. 1A). Alternatively, both arms 66 can start out axial and then both be bent when blade 32 with clip 54 is inserted into slot 56 (FIG. 1A). In other embodiments, arms 66 can start out somewhat pre-bent and then bent further, when engaging concave surface 67 of disk 34 (FIG. 1A).

In summary, clip 54, 54' with locking mechanism 58, 58', support 64, 64' and arm 66, 66', helps to transfer centrifugal load and secure blade 32, 32' to disk 34, 34'. Locking mechanism 58, 58' with head 60, 60' and support that is greater in length in the chordwise direction than neck 62, 62' and support 64, 64' help to minimize stress in root 44, 44' by providing a greater contact area to transfer loads to disk 34. Arms 66, 66' with convex surfaces 67, 67' wrap radially inwards, converging in the axial direction so that the arms are closer at their distal ends than at shoulders 65, 65' to secure clip 54, 54'to concave surfaces 59 of disk 34, minimizing or preventing shifting of blade 32, 32' when in operation. By distributing centrifugal force loads through the thickness of root 44, 44' and transferring part of the loads to disk 34, and providing a stronger connection to minimize or prevent blade shifting, clip 54, 54' improves blade 32 performance and durability, thereby improving overall life of blade 32.

While clip 54, 54' is shown to connect a blade with a firtree root 44 to a disk 32, other types of blades with other types of roots could be used. Additionally, the embodiments shown are for example purposes only, and clip 54 could be sized differently according to system requirements.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A clip to connect a blade to a rotor disk, the blade with a root and a tip in a spanwise direction, and a leading edge and a trailing edge in a chordwise direction, the root with a bottom surface, the clip comprising:

a locking mechanism shaped to engage a complementary slot extending into the bottom surface of the blade root in the spanwise direction, the locking mechanism having a neck and a head with the head connected to the neck and extending a greater length in the chordwise direction than the neck;

a support connected to the neck of the locking mechanism and extending the length of the bottom surface of the root in the chordwise direction; and first and second arms extending radially inward converging in an axial direction so that the arms are closer at their distal ends to engage the rotor disk.

2. The clip of claim 1, wherein the head has an oval cross-section.

3. The clip of claim 1, wherein the head includes a flat upper surface with rounded sides.

4. The clip of claim 1, wherein the length of the head is about ⅓ of the length of the root in the chordwise direction.

5. The clip of claim 1, wherein first and second arms engage the rotor disk with a tight fit.

6. The clip of claim 1, where the first and second arms have convex inner surfaces.

7. The clip of claim 6, wherein the first and second arms engage concave surfaces of the disk.

8. The clip of claim 1, wherein the root is a firtree root.

9. The clip of claim 1, wherein the locking mechanism engages the complementary slot in the blade root by sliding into the blade root from one of a pressure side or a suction side.

10. A self-locking blade to lock to a rotor disk, the self-locking blade comprising:

a blade with a leading edge and a trailing edge in a chordwise direction and a root and a tip in the spanwise direction, the root with a bottom surface and a slot extending into the bottom surface of the root; and a clip with a locking mechanism, a support, and first and second arms, the locking mechanism having a head and a neck attached at one end to the support and at the other end to the head to forma bulbous shape, the locking mechanism shaped to engage the slot extending into the blade root, the support extending the length of the bottom surface of the root in the chordwise direction and the first and second arms connected to the support and extending radially inward to engage a concave surface on the rotor disk.

11. The self-locking blade of claim 10, wherein the head extends a greater length in the chordwise direction than the neck.

12. The self-locking blade of claim 10, wherein first and second arms comprise convex inner surfaces to engage the concave surfaces on the rotor disk with a tight fit.

13. The self-locking blade of claim 10, wherein the locking mechanism engages the complementary slot in the blade root by sliding into the blade root from a pressure side or a suction side.

14. The self-locking blade of claim 10, wherein the clip has a uniform cross-section.

15. A method of locking a blade to a rotor disk with slots, the blade with a root and a tip in the spanwise direction and a leading edge and a trailing edge in a chordwise direction, the root with a bottom surface, the method comprising:

sliding a locking mechanism of a clip into a complementary slot extending from the bottom surface of blade root in the spanwise direction until a support of the clip sits directly below the bottom surface of the blade root, the locking mechanism having a head and a neck with the head extending a greater length in the chordwise direction than the neck and the neck connecting the head to the support;

sliding the clip and blade root axially into a slot in the rotor disk; and bending a first arm on the clip radially inward to engage a concave surface on the rotor disk.

16. The method of claim 15, and further comprising:

bending a second arm radially inward to engage a concave surface on the rotor disk.

17. The method of claim 16, wherein the bending of the first and the second arms further comprises engaging the concave surface of the rotor disk with a tight fit via the clip.

18. The method of claim 15, wherein the step of sliding the locking mechanism of the clip into the complimentary slot extending from the bottom surface of the blade root comprises sliding into the blade root tangentially.

19. The clip of claim 1, wherein the head and the neck of the clip are symmetrical about a plane extending transverse to the support.

20. The self-locking blade of claim 10, wherein the head and the neck of the clip are symmetrical about a plane extending transverse to the support of the clip.

* * * * *

UNITED STATES PATENT AND TRADEMARK OFFICE

CERTIFICATE OF CORRECTION

PATENT NO. : 8,974,188 B2
APPLICATION NO. : 13/412824
DATED : March 10, 2015
INVENTOR(S) : Lin-Jun Hou It is certified that error appears in the above-identified patent and that said Letters Patent is hereby corrected as shown below:

In the Claims

Col. 4, Line 21
Insert --with the neck-- before "attached at one end"

Col. 4, Line 22
Delete "forma"
Insert --form a--

Signed and Sealed this
Fifteenth Day of September, 2015

Michelle K. Lee

Michelle K. Lee
*Director of the United States Patent and Trademark Office*